US012704359B2

(12) United States Patent
Petkov et al.

(10) Patent No.: US 12,704,359 B2
(45) Date of Patent: Aug. 11, 2026

(54) PLASTIC CARTRIDGE CASE FOR ARTILLERY SHOT

(71) Applicant: TRANSARMORY LTD, Sofia (BG)

(72) Inventors: Stancho Petkov Petkov, Sofia (BG); Dobrin Ivanov Ivanov, Sofia (BG)

( * ) Notice: Subject to any disclaimer, the term of this patent is extended or adjusted under 35 U.S.C. 154(b) by 0 days.

(21) Appl. No.: 18/878,103

(22) PCT Filed: Jun. 23, 2022

(86) PCT No.: PCT/BG2022/000009
§ 371 (c)(1),
(2) Date: Dec. 23, 2024

(87) PCT Pub. No.: WO2023/245260
PCT Pub. Date: Dec. 28, 2023

(65) Prior Publication Data

US 2025/0383187 A1 Dec. 18, 2025

(51) Int. Cl.
*F42B 5/196* (2006.01)

(52) U.S. Cl.
CPC ..... *F42B 5/196* (2013.01)

(58) Field of Classification Search
CPC .... F42B 5/26; F42B 5/30; F42B 5/307; F42B 5/295; F42B 5/297; F42B 5/285; F42B 5/196; F42B 7/02; F42B 7/06
USPC ..... 102/464, 465, 466, 467
See application file for complete search history.

(56) References Cited

U.S. PATENT DOCUMENTS

| | | | | | |
|---|---|---|---|---|---|
| 3,170,401 | A * | 2/1965 | Johnson | F42B 5/18 | 102/467 |
| 3,446,146 | A * | 5/1969 | Gawlick | F42C 19/0807 | 102/470 |
| 4,928,598 | A * | 5/1990 | Sabranski | F42B 5/181 | 102/431 |
| 11,821,721 | B2 * | 11/2023 | Smith | F42B 5/285 | |

FOREIGN PATENT DOCUMENTS

| | | | | |
|---|---|---|---|---|
| AT | 259416 B | * | 1/1968 | |
| BG | 4974 U1 | * | 11/2024 | F42B 5/307 |
| BG | 4829 U1 | * | 2/2025 | F42B 5/30 |
| RU | 2096727 C1 | * | 11/1997 | |
| RU | 139493 U1 | * | 4/2014 | |
| RU | 2148241 C1 | * | 4/2020 | |

* cited by examiner

*Primary Examiner* — John Cooper
(74) *Attorney, Agent, or Firm* — PatShegen IP; Moshe Pinchas

(57) ABSTRACT

The invention relates to ammunition, in particular to the construction of composite artillery cartridge cases and can find wide application in the production of general cartridge cases with plastic main body for artillery shots with split-cartridges and unitary loading. The abovementioned cartridge case contain a metal bottom and a plastic body fixed to it, centrally in the metal bottom is made a cylindrically shaped protrusion in which a stepped hole is formed, in which a primer for artillery cartridges is mounted by means of a threaded connection, as at the metal bottom of a plastic main body is placed a mounting ring. In the metal bottom 1 at least two blind holes are formed, with a diameter equal to 0.1 to 0.25 of the diameter of the metal bottom 1 and a depth of 0.35 to 0.5 of the thickness of the bottom of the metal bottom 1, and in the bottom of the plastic main body 2 are formed at least two protruding, fixing elements 6.

8 Claims, 1 Drawing Sheet

PLASTIC CARTRIDGE CASE FOR ARTILLERY SHOT

FIELD OF THE INVENTION

The invention relates to ammunition, in particular to the construction of composite artillery cartridge cases and can find wide application in the production of general cartridge cases with plastic main body for artillery shots with split-cartridges and unitary loading.

BACKGROUND OF THE INVENTION

A composite artillery cartridge case is known, applicable to split-cartridge case shots U.S. Pat. No. 2,564,695, consisting of a main body fixedly connected to a metal bottom, as the main body is being made of sheet plastic with cut edges, on the inner surface of which are specially designed ditches.

In practice, it has been found that when firing projectiles with a pressure of more than 2000 kg/cm$^2$, there is insufficient strength of the connection between the main body and the metal bottom, which is expressed in the disconnection of the connection between the main body and the metal bottom, together with leakage of gunpowder gases, which excludes the possibility of extraction (disposal, removal) of the entire cartridge case. Another disadvantage of the described artillery cartridge case is the incorrectly chosen geometry of the connection between the main body and the metal bottom, as a result of which during long-term storage the gunpowder charge can be moistened, which leads to deterioration of the ballistic characteristics of the charge when firing a shot.

Patent publication U.S. Pat. No. 3,170,401 is known, which discloses a design of a composite cartridge case consisting of a plastic main body, a plastic sealing ring and a retainer. Disadvantage of the known cartridge case is its limited efficiency in shooting at negative temperatures (−50° C.), such as at low pressures, in the range of 1500 kgf/cm2-3000 kgf/cm2. The mutual arrangement of the elements does not provide the necessary compaction of gunpowder gases.

Performed practical tests shows that the temperature coefficient of linear expansion of plastic is greater than that of the coefficient of expansion of the metal from which the metal bottom is made. As a result, at low temperatures, up to minus 50° C. is observed significant clearance between the plastic seal and the walls of the chamber of the cartridge case containing the explosive.

When firing, the plastic seal deforms under the pressure of the gunpowder gases, but the time to compensate for the clearance of the plastic seal is longer than the time for the passage of gunpowder gases from the cartridge case of the seal and as a result of this is a process of leakage of gunpowder gases into the chamber of the cannon, which is unacceptable. However, at low pressures of gunpowder gases (1500-3000 kgf/cm2) insufficient force is formed for plastic deformation of the upper part of the metal bottom, especially within the clearance between the metal bottom and the chamber of the cartridge case, which does not provide the necessary sealing of the main body and the bottom in the their connection area.

Patent publication U.S. Pat. No. 3,026,802 is known, which relates to the construction of a composite artillery cartridge case consists of a metal bottom with a centrally located capsule. That bottom is being connected to a cylindrical plastic main body provided with a metal compression ring which provides a tightness of the place of connection of the plastic main body and the metal bottom. Additionally the strength of the construction of the cartridge case was ensured with the support of a ring located on the outer surface of the walls of the capsule.

When firing process is made in conditions of increased pressure of gunpowder gases from a semi-automatic gun, as well as at small angles of elevation of the barrel, when the energy of the mechanism which close the chamber of the gun reaches maximum, the strength of the cartridge case is insufficient, ie. there are cases of inversion of the main body relative to the metal bottom, which leads to incomplete extraction of the cartridge case, accompanied by the leakage of gunpowder gases, which are characterized by high pressure and temperature, which respectively leads to failure of the firing mechanism of the gun.

Patent publication RU2243487 is known, which describes a composite artillery cartridge case consisting of a metal bottom connected to a plastic main body, providing a compression ring and a rubber pad, the purpose of which is to provide the necessary seal between the main body and the metal bottom. The described technical solution allows the composite cartridge case to be used in artillery cannons with pressure from 350 MPa to 500 MPa.

The described composite artillery cartridge case ensures the achievement of the mentioned technical result in use and as the required strength characteristics of its components are achieved at the expense of the application of appropriate structural sizing and optimization of the optimal connections of dimensions between the plastic main body, the metal bottom and the bottom of the cartridge case. The action of performing shots with the described construction of composite cartridge case shows that when processing composite cartridge cases with a plastic body for artillery systems with a caliber of 152 mm and larger, high ballistic characteristics cannot be achieved, which is mainly due to the fact that after extraction the integrity of the structure of the cartridge case is damaged, which sets a limit for multiple usage of cartridge cases, as that the reliable extraction from semi-automatic guns is not guaranteed.

A composite artillery cartridge case described in RU2148241 consisting of a metal bottom as the central bottom is being provided with a cylindrically shaped protrusion in which a stepped capsule mounting hole is formed, in the inner part of the metal bottom is located the bottom part of a plastic main body. On the bottom of the plastic main body is placed a sealing fastening ring, pressed by a nut fixed on the protruding part of the metal bottom and an airtight pad located between the bottom of the plastic main body and the lower surface of the fastening ring.

The described elements and their mutual arrangement ensure tightness of the connection of the metal bottom and the plastic body, as well as maintain the strength of the connection between the plastic body and the metal bottom under conditions of high pressure firing of powder gases from semi-automatic guns at small angles. The described cartridge case is suitable for use mainly for artillery systems with split-cartridge case loading, medium caliber and above all for howitzers.

One of the main requirements for composite artillery cartridge cases with a plastic body is to ensure the strength of the bottom of the cartridge case and the body in case of firing, reliable extraction and multiple usage. The peculiarity of these cartridge case is that they are used to assemble shots at powerful cannons with large caliber, operating at significantly high pressures in the barrel.

SUMMARY OF THE INVENTION

Considering of the presented known state of the technology in the field in the considered area, it is an object of the invention to provide a composite artillery cartridge case suitable for assembling shots for howitzer and artillery systems with high ballistic characteristics and an operating pressure of more than 500 Mpa, securing the strength of connection of the metal bottom with the main body of the cartridge case, reliability of ignition of the discharging charge and preservation of the integrity of the structure of the cartridge case during firing and after extraction. Another object of the invention is to provide a composite cartridge case, characterized by guaranteed extraction of the shot cartridge case, as well as reliable sealing (obturation) of gunpowder gases during firing, including the possibility of the multiple usage of the cartridge case;

The problem is solved with a composite artillery cartridge case consisting of a metal bottom fixedly connected to a plastic body, and a cylindrically shaped protrusion is formed centrally in the metal bottom, in which a stepped hole is formed, in which a primer for artillery cartridges is mounted by means of a threaded connection, wherein a mounting ring is placed in the inner part of the metal bottom and the plastic main body, and a airtight rubber pad is placed between the bottom of the main body and the lower surface of the mounting ring.

According to the invention, at least two blind holes are formed in the metal bottom, with a diameter equal of 0.1 to 0.25 of the diameter of the metal bottom and a depth of 0.35 to 0.5 of the thickness of the bottom of the metal bottom, and in the bottom of the plastic main body are formed at least two convex, fixing elements with a diameter equal of 0.1 to 0.25 of the diameter of the metal bottom, as the blind holes and the protruding fixing elements correspond in shape, size and location, where at the protruding part of the metal bottom there is a threaded sector, the maximum diameter of the thread in its protruding part D, and the diameter of the hole d for mounting the primer for artillery cartridges is a size in the range from 0.42 to 0.68 of the minimum diameter D of the convex threaded part of the metal bottom.

According to a preferred embodiment of the cartridge case object on the invention, the outer diameter of the clamping retaining ring refers to the diameter of the metal bottom, below the flange and is from 0.66 to 0.87, and its thickness is equal to 0.35 to 0.7 of the thickness of its bottom.

The clamping threaded ring is made with a central threaded hole, of a size corresponding to the threaded sector made on the convex cylindrical surface of the metal bottom, with a diameter D, and at least two holes are made radially in the clamping threaded ring.

According to a preferred embodiment of the cartridge case, four blind holes are formed on the inner surface of the bottom of the metal bottom, and at the bottom of the plastic main body are formed four, radially arranged convex cylindrical protrusions, such as the holes and protrusions are made with dimensions, shape and location, identical to those already specified in the implementation of the cartridge case with two blind holes in the metal bottom and two protrusions in the plastic main body.

Preferably, the outer radius R/main body/of the side surface of the plastic main body with its bottom to be made with a radius of 0.6-1.3 of the inner radius R/bottom/of the metal bottom/.

According to one embodiment of the cartridge case, an antistatic graphite coating is applied to the inner surface of the plastic main body.

According to another embodiment of the cartridge case, the main body of the cartridge case is made of plastic, which contains an antistatic substance.

In alternative embodiment of the cartridge case on the metal parts is applied a protective zinc-phosphate or chrome coating, with a thickness of not less than 7 μm. The main body of the cartridge case is made of low pressure polyethylene (high density), obtained by suspension and gas phase methods, by polymerization of ethylene at low pressure.

According to one embodiment of the cartridge case, four blind holes with a diameter equal to 0.1 . . . 0.25 of the diameter of the metal bottom and a hole depth of 0.35 to 0.25 are formed on the inner surface of the bottom of the metal bottom. 0.5 of the thickness of the bottom of the metal bottom.

The pressing disk has a central threaded hole, by means of which the pressing disk is mounted to the convex cylindrical surface of the metal bottom, and radially two or four technological holes are made on the pressing disk for tightening the main body of the cartridge case to the metal bottom.

Preferably, the maximum diameter of the thread in the convex part of the metal bottom intended for mounting the pressure disk is in the range from 1.3 to 1.42 of the minimum diameter of the thread for screwing the primer for artillery cartridges, and the diameter of the mounting hole of the primer for artillery cartridges is made in the range from 0.42 to 0.68 of the minimum diameter of the protruding threaded part of the metal bottom.

In one embodiment of the cartridge case, it is suitable to mount an additional second disk for pressing and to place a plastic cover with one or more rubber sealing rings and a plastic retainer on it;

The radius of connection of the forming outer cylindrical surface with its bottom surface is defined from 0.6 of 1.2 of the inner radius of the metal bottom;

At the bottom of the plastic main body are formed four, radially arranged convex cylindrical protrusions with a diameter equal of 0.1 to 0.25 from the diameter on the metal bottom, dimensions and location of the mentions before protrusions corresponds perfectly to the blind holes made in the bottom of the inner profile of the metal bottom.

In one embodiment of the cartridge case, the pressing disc is made in compliance with the ratio between the outer diameter of the pressing disk to the diameter of the metal bottom (below the flange) and is in the range from 0.66 to 0.87, and the thickness of the pressing disk is equal to 0.35 to 0.7 of the thickness of its bottom.

In one embodiment of the cartridge case, it is suitable to mount an additional second press disk and to place a plastic cover with one or more rubber sealing rings and a plastic retainer on it;

It is also preferable to apply an antistatic graphite coating to the inner surface of the plastic main body.

In another embodiment of the cartridge case, it is suitable for the main body of the cartridge case to be made of plastic containing an antistatic substance which prevents the occurrence of an electric discharge of static electricity when friction of the elements inside the cartridge case, for example the bags with ejecting charge in the walls of the cartridge case.

The problem is solved with a composite cartridge case consisting of a metal bottom, a plastic main body, pressing disk and a rubber seal placed inside it. The cartridge case is characterized by the fact that the inner surface of the metal bottom has two holes, where the maximum diameter of the thread in its protruding part for mounting the pressing disk on the metal bottom is made in the range of 0.42 to 1.42 of the minimum diameter of the thread for screwing the primer for artillery cartridges, and the diameter of the hole for screwing the primer for artillery cartridges is made in the range from 0.42 to 0.68 of the minimum diameter of the protruding threaded part of the metal bottom.

According one embodiment of the cartridge case, at least two blind holes are made on the inner surface of the metal bottom with a diameter equal to 0.1 to 0.25 of the diameter of the metal bottom and a depth of 0.35 to 0.5 of the thickness of the metal bottom, where the maximum diameter of the thread in its convex part for mounting the pressing disk of the metal bottom is made in the range from 1.3 to 1.42 of the minimum diameter of the thread for screwing the primer for artillery cartridges, and the diameter of the hole for screwing the primer for artillery cartridges is made in the range of 0.42 . . . 0, 68 of the minimum diameter of the convex threaded part of the metal bottom/steel flange with central threaded hole/.

Respectively, at the bottom of the plastic main body, from two to four blind holes with a diameter of 0.1 to 0.25 of the diameter of the metal bottom are made, corresponding to the blind holes on the inner profile of the metal bottom, ensuring impossibility of scrolling of the metal bottom in the main body of the cartridge case during extraction and fix the metal bottom to the main body towards to the other structural elements of the cartridge case during assembly.

The realization of the maximum diameter of the thread at the place of the metal bottom in the range from 0.4 to 0.75 from the minimum diameter of the protruding part of the inner surface of the metal bottom (the place for mounting the primer for artillery cartridges), which provides storage, strength and integrity of the protruding part of the metal bottom, ensuring reliable extraction of the fired cartridge case, at which excludes the possibility of deformation under the action of gunpowder gases on the device for ignition of the threaded socket.

The realization of the maximum diameter of the hole for the primer for artillery cartridges in the range from 0.22 to 0.93 of the minimum diameter of the protruding part of the inner surface of the metal bottom allows to ensure reliable and uniform ignition of the discharging charge located in the cartridge case and to save the strength at the top part in the thread of the metal bottom.

The composite cartridge case, the object of the invention is characterized by an improved design, mainly due to the effective design solution in terms of pressurizинг when connecting the two main elements:

metal bottom and main body of cartridge case, thus achieving long-term preservation of the tightness of the discharging charge located inside the cartridge case, as well as preservation of the ballistic characteristics of the discharging charge, protecting it from the influence of external factors during prolonged storage and official circulation.

The technical solution for the use of a plastic as a construction material for the main body of the cartridge case, avoids the formation of significant end loads between the main body of the cartridge case and the chamber of the gun, which greatly facilitates its extraction after firing. At the same time the use of ordinary materials in the construction of the cartridge case-plastic and structural steels the metal bottom allows to organize the production of such cartridges cases without the need for the use of heavy pressing equipment, while achieving high technical and economic performance.

Currently, manufacturers are focusing their efforts on the design improvement of artillery shots, which aims to increase the distance, improve the grouping of firing and improve performance.

In this regard, the artillery cartridges cases are subject to increased requirements for ensuring the strength and integrity of the structure, the tightness of the gunpowder discharging charge, the reliability of extraction and the possibility of making the structure from inexpensive and widespread structural materials.

The realization of the airtight device in the shape of a plastic cover with rubber sealing rings and a clamp, ensuring the protection of the discharging charge from external influences under extremely unfavorable combat conditions, transportation and operation, applying the plastic main body to of the cartridge case with graphite coating, which completely excludes the possibility of accumulation of static electricity, which under certain conditions may initiate ignition of the discharging charge placed in the composite cartridge case, wrapped in paper and placed in a transport packaging, which allows to protect against the effects of external factors during transportation and storage.

DESCRIPTION OF THE DRAWINGS

An example of a composite cartridge case, object of the invention is presented in the drawings accompanying the description, where.

EXAMPLE EMBODIMENT OF THE INVENTION

Figure 1:
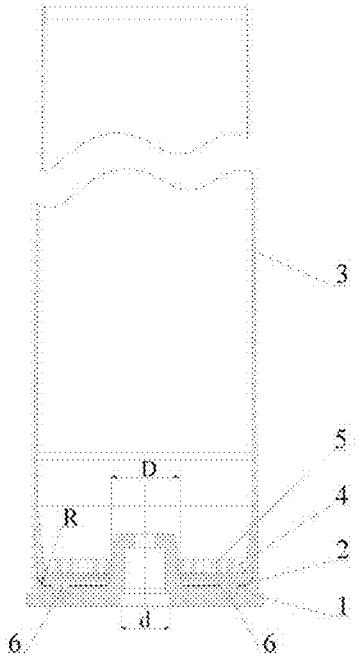
FIG. 1—General view of a composite artillery cartridge case, object of the invention.
Figure 2:
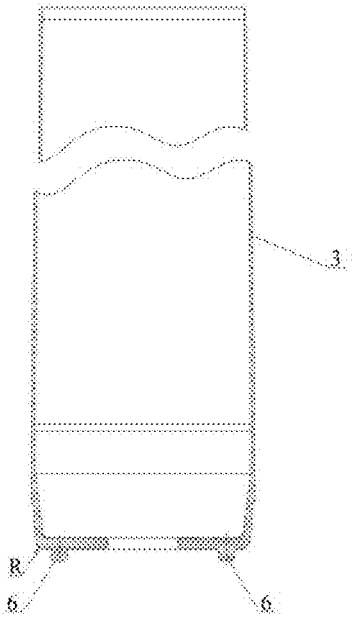
FIG. 2—General view of a plastic main body of a composite artillery cartridge case in a particular embodiment, object of the invention.

A composite cartridge case according to the invention consists of a metal bottom 1, with a centrally threaded socket with an internal thread, in which a primer for artillery cartridge is placed, in which a plastic main body 3 is fixedly mounted at the metal bottom, located at the bottom of the main body 3 elastic sealing pad 2 and compression ring 4.

On the inner surface of the bottom of the metal bottom 1 are formed at least two, preferably four blind holes, with a diameter equal to 0.18 of the diameter of the metal bottom, the depth of the holes is 0.42 of the thickness of the bottom of the metal bottom 1.

The maximum diameter R of the thread in the convex part of the metal bottom 1, shaped for the purpose of mounting the compression ring 4 in the metal bottom 1 is 0.35 of the minimum diameter d of the thread for winding the explosive device, in this case-a primer for artillery cartridges, and the diameter of the screw hole of the primer for artillery cartridges is within 0.55 of the minimum diameter D of the convex threaded part of the metal bottom 1.

At least two, preferably four convex cylindrical surfaces 6, with a diameter equal to 0.18 of the diameter of the metal bottom 1, are made on the bottom of the plastic main body 3. The protrusions corresponding in shape, size and location of the blind holes formed on the inner profile of the metal bottom 1.

According to a preferred embodiment, the plastic main body 3 of the cartridge case is made of plastic, which contains an antistatic substance, ensuring the prevention of electric shock from static electricity when rubbing the elements inside the cartridge case (bags with discharging charge) in the walls of the cartridge case.

Preferably, the main body of the cartridge case 3 is made of high density polyethylene, obtained by suspension and gas phase methods, by polymerization of ethylene at low pressure.

It is appropriate to specify that the added antistatic additive to the plastic of the main body 3 "migrates" to the surface of the main body, due to the relative incompatibility with the polymer, creating a conductive layer by absorbing atmospheric moisture.

The antistatic additive can be used in the production of the main body 3 by various manufacturing methods, such as injection molding or casting, and its application has an instantaneous and long-lasting effect, long-term antistatic properties, low humidity efficiency, but also more pronounced low resistance obtained through the use of amine-based substances.

During designing process of the main body 3 with antistatic additive, the process temperature should not exceed 250° C. in order to avoid degradation or deterioration of the properties of the antistatic layers, which may be affected by other components in the layer, for example other "migrating" additives, such as glidants, leading to greasy surfaces and altering the antistatic effect.

In one embodiment of the cartridge case, the clamping thread ring 4 according to its outer diameter towards the diameter of the metal bottom 1, in particular below the flange, is equal to 0.77 and the thickness equal to 0.55 from the thickness of its bottom, and these parameters provide the necessary hardness of the compression ring 4, respectively provides hardness and integrity of the compound of the plastic main body 3 of the cartridge case with the metal bottom 1. Such hardness is especially necessary in the conditions of vigorous extraction of the fired cartridge case at small angles of elevations on the barrel, when the energy of the recoil devices of the gun is significant, and as a consequence—the extraction speed of the fired cartridge case reaches its maximum value.

The compression ring 4 is made with a central threaded hole, with a diameter D, defined so that the compression ring 4 is screwed to the convex cylindrical surface with a diameter D of the metal bottom 1.

At least two, preferably four technological openings 5 are formed radially on the clamping ring 4, intended for clamping the plastic main body 3 to the metal bottom 1.

It is suitable the radius of connection of the forming on the outer cylindrical surface R of the compression ring 4 with its bottom surface is equal to 0.9 of the inner radius of the metal bottom 1.

The embodiment of the outer adjacent radius of the forming on the side surface of the plastic main body 3 with its bottom surface is equal to 1.2 of the inner radius of the metal bottom 1.

It is appropriate to pay attention to the fact that when performing the adjacent radius of the outer forming surface of the plastic main body 3 with the bottom, i.e. with a radius of less than 0.6 of the inner radius of the metal bottom 1, in this embodiment the contact area of the adjacent surfaces of the plastic main body 3 and the metal bottom 1 with the sealing rubber pad 2 is sharply reduced, as a result of which it cannot be secured the required tightness of the connection between the metal bottom 1 and the plastic main body 3.

In the embodiment of the adjacent radius R of the outer forming surface of the main body 3 with the bottom, i.e. with a radius greater than 1.8 of the inner radius of the metal bottom 1, the contact area of the adjacent surfaces between the plastic main body 3 and the metal bottom 1 and the sealing pad 2 is significantly increased. In this embodiment, uniform deformation of the metal bottom 1 with the rubber sealing pad 2 is not ensured, as a result of which the guaranteed tightness of the joint between the metal bottom 1 and the main body 3 cannot be achieved again.

The implementation of the maximum diameter of the hole for the primer for artillery cartridges less than 0.22 of the minimum diameter of the protruding part of the inner surface of the metal bottom, makes it difficult to spread the forcing of the fire from the primer for artillery cartridges to the discharging charge, which causes unevenness of its ignition, accompanied by a high pressure of gunpowder gases beyond the permissible limit. This phenomenon leads to an increase in the radial deformation of the walls of the metal bottom and the chamber of the cannon, the formation of significant radial contractions between the walls of the metal bottom and the chamber of the cannon and the impossibility of extraction of the shot cartridge case.

The implementation of the maximum diameter of the opening of the primer for artillery cartridge, more than 0.93 from the minimum diameter of the protruding part of the inner surface of the metal bottom, causes at the time of operation of the ignition parts, destruction of the protruding part of the metal bottom, which excludes multiple usage of the fired cartridge case, due to the uneven distribution of the pressure gradient in the inner surface of the cartridge case and reducing the wall thickness of the upper end of the protruding part of the metal bottom.

In one embodiment of the cartridge case according to the invention, the cartridge case comprises a second compression ring 4', ensuring the reliability of the connection of the plastic main body 3 with the metal bottom 1. This embodiment is suitable for cartridge cases used under operating conditions at fast rate guns and automatic system for nudging the cartridge case with the charge in the chamber of the cannon.

The main body of the cartridge case 3 could be made from plastic, in the composition of which is added from 3 to 5% antistatic substance. Such an additive prevents the occurrence of an electric discharge of static electricity, which usually occurs when the elements (bags with discharging charge) rub inside the cartridge case, more precisely in the walls of the cartridge case.

The above-described composite artillery cartridge case works as follows: The convex cylindrical parts 6 of the main body 3 are fixed in the blind holes of the metal bottom 1, the rubber sealing pad 2 is placed between them and in the case of such an assembly, the clamping ring 4 is mounted, which is screwed by means of the radial technological openings 5 by means of a special wrench, with a certain tightening force, to the convex part of the inner cylindrical surface D of the metal bottom 1.

The cartridge case with the ejection of the powder charge is placed in the chamber of the cannon. After activation of the primer for artillery cartridges, begin ignition and complete combustion of the discharging charge. The pressure of the gunpowder gases acts on the walls of the plastic main body 3, causing radial deformations of the walls of the metal bottom 1. In this case, there is a simultaneous deformation of the cut of the metal bottom 1, while creating favorable conditions for interaction of the bottom 1 and the plastic main body 3 with providing transverse strength of the plastic main body.

The walls of the convex inner part of the metal bottom 1 with diameter D are deformed elastically, preserving its strength and preventing the deformation of the means for igniting gunpowder gases and excluding the possibility of leakage (breakthrough) of gunpowder gases in the chamber of the cannon.

This ensures guaranteed extraction of the cartridge case after the shot, as well as the possibility of multiple usage of the fired cartridge cases.

In the process of producing the shot, the bottom part of the metal bottom 1 undergoes radial elastic-plastic deformations without forming significant end wedges between the outer surface of the metal bottom 1 and the chamber of the cannon, which provides the necessary reliability at extraction of the fired cartridge case.

The plastic main body 3 is deformed in the process of firing, without the formation of cracks, thanks to the optimal degree of deformation of the walls, which ensures the integrity of the structure.

The design of the cartridge according to the invention increases the reliability of its operation in the composition of the artillery shot and, as a consequence, the efficiency of firing in general.

The invention can be used in the development of various types of artillery cartridge cases.

LEGEND

1. bottom;
2. rubber sealing pad;
3. plastic main body;
4. clamping threaded ring;
5. radial technological holes for tightening the threaded ring;
6. convex cylindrical surfaces from 2 to 4 pcs. at the bottom of the cartridge case;
D—diameter of the cylindrical part of the inner surface of the bottom;
d—diameter of the socket for screwing the primer for artillery cartridges;
R—transition radius between the outer and bottom surface of the plastic main body;

The invention claimed is:

1. A composite artillery cartridge case containing a metal bottom and a plastic body fixed to the metal bottom, the metal bottom includes a cylindrically shaped protrusion which includes a stepped hole, in which a primer for artillery cartridges is mounted by means of a threaded connection, as the metal bottom and the plastic body (3) are connected by a clamping fastening ring (4), and between the bottom of the plastic body (3) and the lower surface of the clamping fastening ring (4) is placed a sealing pad, characterized in that the metal bottom (1), is provided with inner radius and in which at least two blind holes are formed, with a diameter equal to 0.1 to 0.25 of the diameter of the metal bottom (1), and a depth of 0.35 to 0.5 of the thickness of the bottom of the metal bottom (1), and in the bottom of the plastic body (3) are formed at least two protruding, fixing elements (6), with a diameter equal from 0.1 to 0.25 of the diameter of the metal bottom (1), as the blind holes and the protruding fixing elements correspond in shape, size and location, whereby in the cylindrically shaped protrusion (6) of the metal bottom (1) threaded sector is made.

2. The composite artillery cartridge case according to claim 1, characterized in that the ratio between the outer diameter of the clamping fastening ring (4) and the diameter of the metal bottom (1) under the flange is in a range of 0.66 to 0.87, and the ratio between the thickness of the clamping fastening ring (4) and the thickness of the metal bottom (1) is in a range of 0.35 to 0.7.

3. The composite artillery cartridge case according to claim 1, characterized in that the clamping fastening ring (4) has a central threaded hole with a size corresponding to the threaded sector made on the cylindrically shaped protrusion (6) of the metal bottom (1) with diameter D, and wherein the clamping fastening ring (4) includes at least two holes (5).

4. The composite artillery cartridge case according to claim 1, characterized in that the outer radius R of a side surface of the plastic body (3) with its bottom is made with a radius of 0.6 to 1.3 of the inner radius of the metal bottom (1).

5. The composite artillery cartridge case according to claim 1, characterized in that an antistatic graphite coating is applied to the inner surface of the plastic body (3).

6. The composite artillery cartridge case according to claim 1, characterized in that the plastic body (3) of the cartridge case is made of plastic, which contains an antistatic substance.

7. The composite artillery cartridge case according to claim 1, characterized in that a protective zinc-phosphate or chromium coating with a thickness of not less than 7 μm is applied to the metal parts of the cartridge case.

8. The composite artillery cartridge case according to claim 1, characterized in that the plastic body (3) of the cartridge case is made of low pressure polyethylene and high density.

* * * * *